US007654415B2

(12) United States Patent
van der Heijden

(10) Patent No.: US 7,654,415 B2
(45) Date of Patent: Feb. 2, 2010

(54) DISPENSING UNIT

(75) Inventor: Edgar Ivo Maria van der Heijden, Broek op Langedijk (NL)

(73) Assignee: Airspray International B.V., Alkmaar (NL)

( * ) Notice: Subject to any disclaimer, the term of this patent is extended or adjusted under 35 U.S.C. 154(b) by 188 days.

(21) Appl. No.: 10/507,023

(22) PCT Filed: Mar. 11, 2003

(86) PCT No.: PCT/NL03/00182

§ 371 (c)(1),
(2), (4) Date: Mar. 14, 2005

(87) PCT Pub. No.: WO03/078075

PCT Pub. Date: Sep. 25, 2003

(65) Prior Publication Data

US 2005/0150905 A1 Jul. 14, 2005

(30) Foreign Application Priority Data

Mar. 19, 2002 (NL) ..... 1020200
Dec. 18, 2002 (NL) ..... 1022197

(51) Int. Cl.
*B67D 5/52* (2006.01)

(52) U.S. Cl. ..... 222/135; 222/129

(58) Field of Classification Search ..... 222/135–142, 222/129, 142.1–142.3, 153.05, 153.13, 143, 222/145.1, 145.5; 215/6; 220/500, 501, 220/502

See application file for complete search history.

(56) References Cited

U.S. PATENT DOCUMENTS 4,384,660 A * 5/1983 Palmisano et al. ..... 222/153.07
4,496,081 A * 1/1985 Farrey ..... 222/135
4,826,048 A * 5/1989 Skorka et al. ..... 222/137
5,005,736 A * 4/1991 Portas ..... 222/135
5,356,040 A * 10/1994 Reggiani ..... 222/129

(Continued)

FOREIGN PATENT DOCUMENTS

EP 0 443 519 A2 2/1991

(Continued)

*Primary Examiner*—Lien T Ngo
(74) *Attorney, Agent, or Firm*—Hoffmann & Baron, LLP

(57) ABSTRACT

The invention relates to a combination of a first container and a second container to form a dispensing unit. The first and second containers each have a reservoir for a liquid substance and pump which is secured to the reservoir, can be actuated by hand and has a dispensing opening and a pump-actuating button for dispensing substance from the reservoir. The combination also comprises coupling means for coupling together the first and second containers in a position next to one another. The invention is characterized in that the coupling means comprise: one or more first coupling members, which are each arranged on the first container, and one or more second coupling means, which are each arranged on the second container and which can each be directly coupled to an associated first coupling member on the first container. It is preferable for a first coupling member and an associated second coupling member each to be arranged fixedly on the assembly of reservoir and pump of the associated container in order to create a stable coupling between the assemblies reservoir and pump of the two containers.

31 Claims, 5 Drawing Sheets

U.S. PATENT DOCUMENTS

| | | | | |
|---|---|---|---|---|
| 5,740,947 | A * | 4/1998 | Flaig et al. | 222/135 |
| 6,082,588 | A * | 7/2000 | Markey et al. | 222/137 |
| 6,422,425 | B1 * | 7/2002 | Tada | 222/153.07 |
| 6,672,483 | B1 * | 1/2004 | Roy | 222/145.1 |
| 6,726,016 | B2 * | 4/2004 | Chen | 206/581 |
| 6,758,411 | B2 * | 7/2004 | Conway et al. | 239/303 |
| 7,021,499 | B2 * | 4/2006 | Hansen et al. | 222/145.5 |
| 7,137,531 | B2 * | 11/2006 | Arghyris et al. | 222/94 |
| 7,195,135 | B1 * | 3/2007 | Garcia et al. | 222/137 |
| 2001/0025860 | A1 | 10/2001 | Auer | 222/137 |

FOREIGN PATENT DOCUMENTS

| | | |
|---|---|---|
| FR | 2 799 446 | 10/1999 |
| GB | 2 317 654 A | 8/1997 |
| JP | 61-129728 | 8/1986 |
| JP | 4-102569 | 4/1992 |
| JP | 5-24583 | 3/1993 |
| JP | 7-548 | 1/1995 |

* cited by examiner

DISPENSING UNIT

This application is the National Stage of International Application No. PCT/NL03/00182, filed 11 Mar. 2003, which claims the benefit of Netherlands Application No. NL 1020200, filed 19 Mar. 2002, which claims the benefit of Netherlands Application No. NL 1022197, filed 18 Dec. 2002, the contents of which is incorporated by reference herein.

FIELD OF THE INVENTION

The present invention relates to a combination of a first container and a second container to form a dispensing unit for liquid substances in accordance with the preamble of claim 1.

BACKGROUND OF THE INVENTION

EP 0 243 667 has disclosed a dispensing unit with two containers which each have a reservoir for a liquid substance. On the top side, each of the containers has an opening in which a pump is positioned. The containers are connected to one another in a position next to one another by a common bridge piece. The bridge piece has two openings, in which the open end of the respective containers can be positioned and secured by means of a screw thread or a bayonet connection. In this case, the pumps are in each case clamped between the bridge piece and the top edge of the associated container. In the known dispensing unit, the pumps are actuated with the aid of a common pump-actuating head.

A drawback of the known dispensing unit resides in particular in the field of the production of filled dispensing units. For example, the reservoirs in the known unit have to be secured to the bridge piece immediately after they have been filled, so that the reservoirs are closed off by means of the pumps. An alternative could be for the filled reservoirs initially to be closed off by means of a temporary lid or the like, which then has to be removed again later in the production process in order for the reservoirs to be secured to the bridge piece. This temporary closure and reopening of a reservoir is undesirable.

SUMMARY OF THE INVENTION

The object of the invention is to provide a combination of containers for assembling a dispensing unit, in which the containers do not have to be coupled immediately after they have been filled (although the invention does permit this option).

The object is achieved by a combination of containers according to claim 1.

The combination of containers according to the invention permits various forms of production and/or operation by the user, partly as a function of the design of the coupling members. This is not the case with the known dispensing unit.

For example, it is conceivable for the reservoirs to be filled, the pumps to be put in place and the filled containers then to be stored in the uncoupled state in order to be coupled in the desired combination at a later stage. It is also possible for the containers to be coupled immediately after they have been filled, in which case it is then possible to achieve a liquid-tight state immediately after the containers have been filled and the pump has been put in place, thus preventing spillage of liquid and/or introduction of impurities into the reservoir.

Furthermore, it is conceivable for the containers to be sold in the uncoupled state, so that the user can make up the desired combination. On the other hand, it is also possible for the coupling to be produced in the factory and to be more or less permanent, so that it cannot be detached, or can only be detached with difficulty, by the user.

In a version in which subsequent uncoupling of the containers is possible, there is also the option of making up all kinds of combinations, filling empty containers and/or replacing them, etc.

The pump or pumps may if appropriate be foam-forming pumps.

It is preferable for the coupling means for different sizes of containers to be of uniform design, so that containers of different dimensions can be coupled to one another. The options when assembling dispensing units are then not limited by dimensions of the containers, as is the case in the prior art, in which a specific bridge piece is only suitable for a specific cross section of the connection of the reservoirs.

It is preferable for the coupling members to be formed integrally on the relevant components of the containers, for example during the injection-moulding of suitable plastics material, and it is also preferable for the coupling members to comprise hook elements which can be coupled to complementary coupling members.

In a particular embodiment, each container is provided with a blocking element for blocking the pump-actuating button, so that the pump cannot be actuated inadvertently. This is particularly advantageous during storage of the containers, when it is possible that a force may be exerted on the actuating button of the pump. Moreover, a blocking element of this type can be used as a tamper-evident element. The blocking element is preferably designed to be removable, for example by being broken off.

In an alternative embodiment of the dispensing unit according to the invention, the dispensing unit comprises a reservoir holder which at least partially holds the first and second reservoirs. A reservoir holder of this type ensures a good, stable connection between the two containers.

In this case, it is advantageously possible for the reservoir holder to be made from two parts which are each suitable for holding one reservoir and can be coupled to one another. The two parts can preferably be coupled to one another by means of coupling members which can be designed in a corresponding way to the coupling members according to the invention for coupling a first container and a second container to one another.

BRIEF DESCRIPTION OF THE DRAWINGS

The combination of containers for assembling a dispensing unit according to the invention will be explained below with reference to the drawing, in which.

DETAILED DESCRIPTION OF PREFERRED EMBODIMENTS

Figure 1:
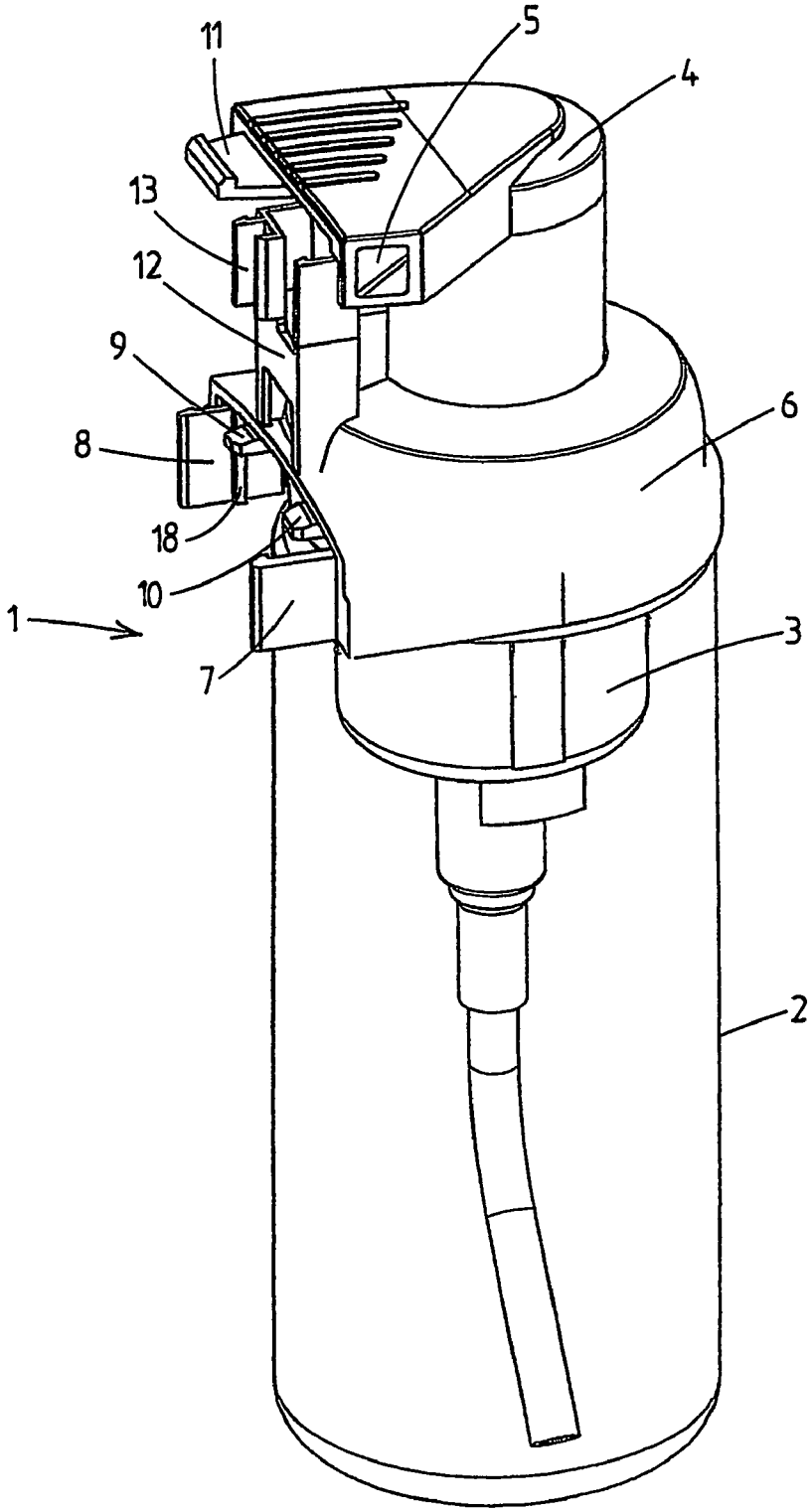
FIG. 1 shows an embodiment of a container according to the invention.

FIG. 1 shows an embodiment of a container according to the invention which is denoted overall by reference numeral 1. The container 1 comprises a reservoir 2 for a liquid substance, which can be pumped out of the reservoir 2 and dispensed by means of a pump 3 which can be actuated by hand, for example in the form of a foam.

The reservoir 2 has a base and an opening at the top side, into which the housing of the pump 3 fits.

The pump 3 can be actuated using a pump-actuating button 4, which can be moved up and down, on the top side of the pump 3, during which process a liquid, for example in foam form, flows through a dispensing passage to a dispensing opening 5 in the button 4, where it is dispensed. The dispensing passage in this case runs through the button 4.

In the case of foam, the foam can be obtained as a result of a liquid being mixed with air in the reservoir.

It is also possible for one of the reservoirs or both reservoirs to be of the airless type, in which case the base of the reservoir is at least partially formed by a piston. This piston moves towards the pump as liquid is pumped out of the reservoir, in order to compensate for the space which was occupied by the liquid which has been pumped out.

Furthermore, the container comprises a securing collar 6, by means of which the pump 3 is fixed to the reservoir 2. In the embodiment shown, the securing collar 6 is screwed onto the neck of the reservoir 2 and then clamps in place a flanged edge of the pump 3. A bayonet catch, snap-action connection or other embodiment is also possible, however.

Two hook-shaped first coupling members 7, 8, which project on one side of the container 1, are arranged on the securing collar 6 in order to couple the securing collar 6 of the container 1 to a securing collar of a second container to form a dispensing unit according to the invention. In the process, the hook-shaped coupling members 7, 8 are coupled to complementary second coupling members in the form of hook edges 17', 18' (not visible in FIG. 1) on a securing collar 6' of the second container 1'. The positioning lips 9, 10 engage beneath an edge of the securing collar 6' of the second container 1'.

Because coupling members 7, 8 and associated hook edges 18', 17' of the collar 6, 6' are complementary with respect to one another, the securing collars 6, 6' of the two containers which are to be coupled to one another can be of identical design. In this case, it is not necessary for the reservoirs to be identical. By way of example, it is possible to combine a container for a base liquid having a large reservoir with a container for a specific concentrate which is inside a smaller reservoir. On account of the fact that the coupling means are in this case releasable, it is easy for a plurality of containers holding concentrates to be interchanged.

A coupling member 11, which can be coupled to a pump-actuating button 4' of the second container 1', is formed integrally on the pump-actuating button 4. For this purpose, there is a hook edge 11*a* on the coupling member 11.

On the securing collar 6 there is a blocking element 12 which ensures that the pump-actuating button 4 cannot be depressed, so that the pump cannot be actuated when the blocking element 12 is present. The blocking element 12 can be broken off, so that after the blocking element 12 has been removed the pump can be activated by using the pump-actuating button 4. The blocking element 12 can also serve as a tamper-evident means indicating use of the container. After all, once the blocking element 12 has been broken off, it cannot be restored to its original state.

Furthermore, a coupling member 13, which during coupling of the container 1 to a second container 1' is coupled to a coupling member 13' on a blocking element 12' of the second container 1', is also arranged on the blocking element 12. This coupling member 13' is also of complementary design, so that the same securing collar 6 with an integrally formed blocking element 12 can be used for both containers 1, 1' which are to be coupled to one another.

Figure 2:
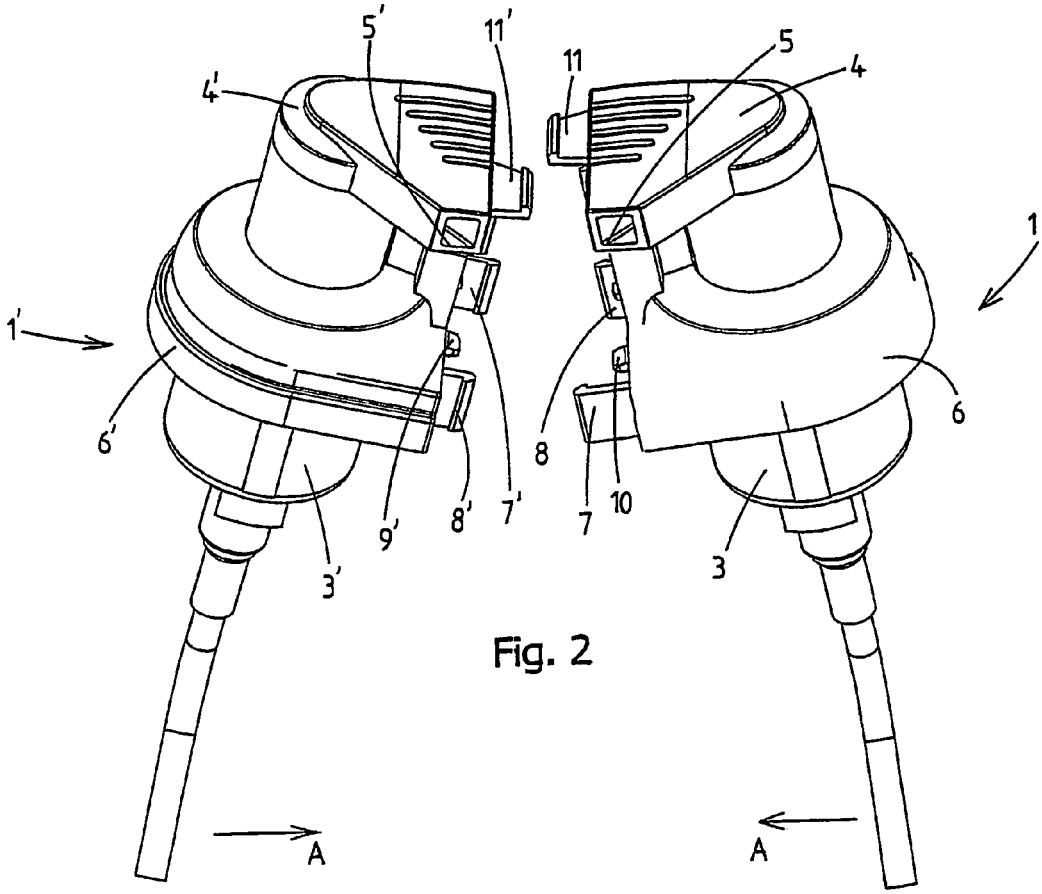
FIG. 2 shows a first container and a second container (reservoirs not shown), which are illustrated in a starting state for the two containers to be coupled to one another to form an assembly according to the invention.

FIG. 2 shows a starting position of a first container 1 and a second container 1', which is similar but not identical, which containers 1, 1' can be coupled to one another in order to form a dispensing unit. The reservoirs of the containers 1, 1' are not shown, in order to provide a clear view of the coupling between the containers.

The securing collars 6, 6' of the two containers 1, 1' are in this case of identical design. This is possible because each pair of coupling members 7, 8 and 7', 8' of a collar 6 and 6', respectively, has complementary coupling members.

Furthermore, the drawing clearly illustrates that the pump-actuating buttons 4, 4' of the two containers 1, 1' are designed to be substantially mirror-symmetrical. The dispensing opening 5 lies close to the bearing surface of the container, so that the dispensing opening 5 lies next to a dispensing opening 5' of the second container 1' when they have been coupled to one another. The liquids which are then dispensed when the pump-actuating buttons 4, 4' are actuated are dispensed in the vicinity of one another, so that the liquids can easily be collected using one hand or the like.

When the two containers 1, 1' are being coupled to one another, first of all the pump-actuating buttons 4 are brought into engagement with one another by means of the coupling members 11, 11', which each engage behind a downwardly projecting hook edge of the other button 4', 4. In this position, the containers 1, 1' are at an oblique angle. Then, the containers 1, 1' are pivoted towards one another (as indicated by the arrows A in FIG. 2), during which movement the buttons 4, 4' which have been hooked together form a hinge, so that the other coupling members 7, 8, 7', 8', 17, 17', 18, 18' of the two containers 1, 1' are coupled to one another.

Figure 3:
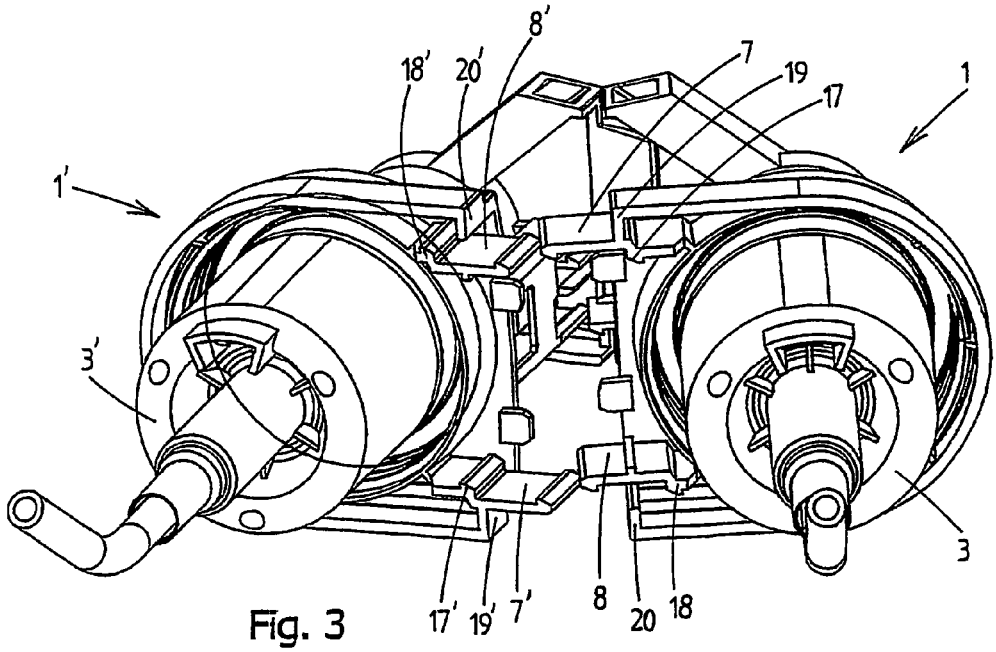
FIG. 3 shows a first container and a second container (reservoirs not shown) which are illustrated during the coupling of the two containers.

FIG. 3 shows the containers 1, 1' just before complete coupling has been effected. In this figure too, the reservoirs are not shown. It can be seen that the hook-shaped coupling member 7' can hook behind the associated hook edge 18', and the coupling member 8 can hook behind the hook edge 17'. Furthermore, the hook-shaped coupling members 7', 8' of the second container 1' are coupled to the hook edges 18, 17 of the first container 1. It is also possible to see the stops 19, 20 and 19', 20' of the collars 6 and 6', respectively, which bear against one another in the coupled state.

Figure 4:
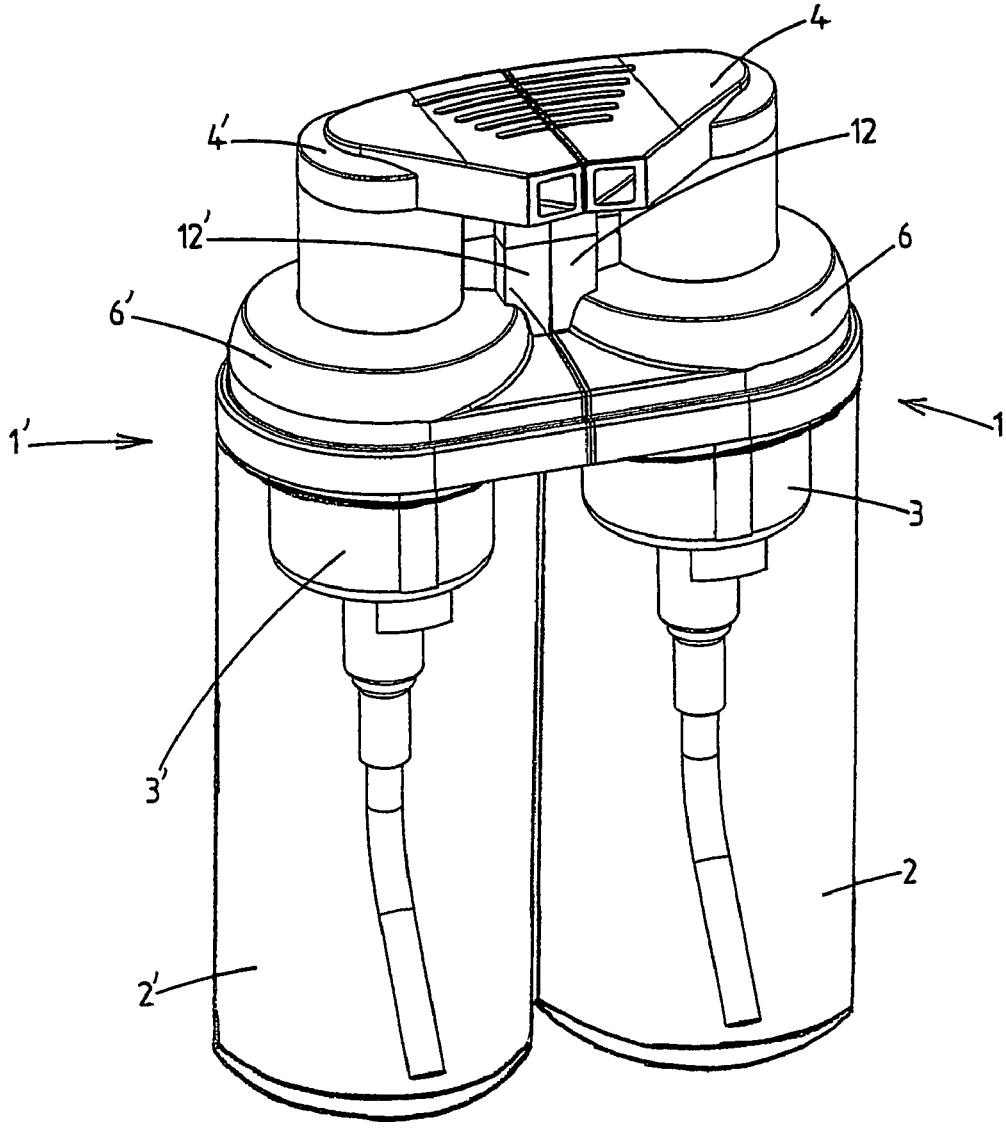
FIG. 4 shows a dispensing unit composed of two containers which have been coupled to one another in accordance with the invention.

FIG. 4 shows the two containers 1, 1' from FIG. 3, but now in the completely coupled state. The embodiment of the coupling means which has been described produces a strong, torsionally rigid coupling. This torsional rigidity is advantageous during the actuation of the pumps.

FIG. 4 clearly shows that the two blocking elements 12, 12' bear against one another. On account of the presence of these blocking elements 12, 12', the pumps 3, 3' cannot be actuated. The blocking elements 12, 12' shown in this case are coupled to one another by means of coupling members 13 as shown in FIG. 1. After the blocking members 12, 12' have been broken off, the pumps 3, 3' can be operated.

Figure 5:
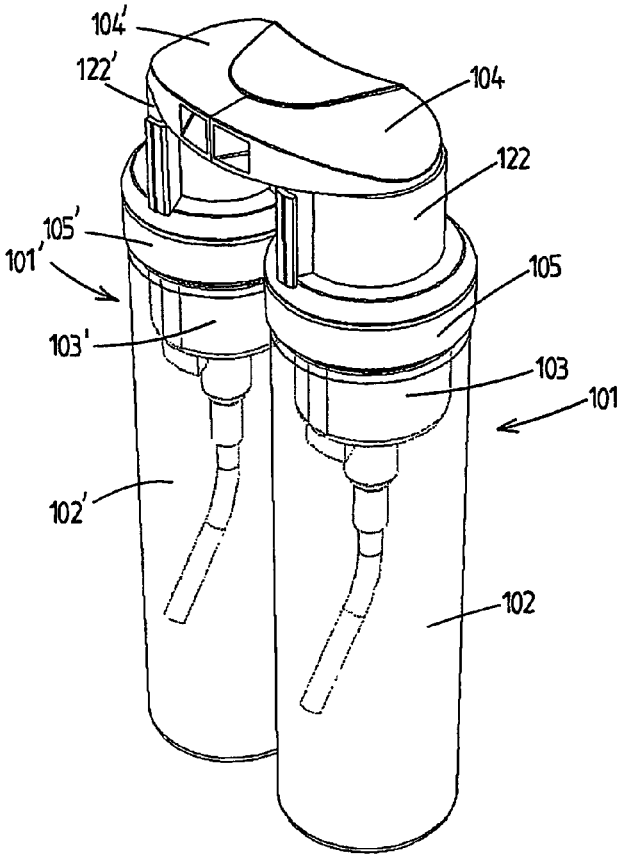
FIG. 5 shows an alternative embodiment of a combination of a first container and a second container according to the invention.

FIG. 5 shows an alternative embodiment of a combination of a first container and a second container according to the invention, the first and second containers being denoted by reference numerals 101 and 101', respectively. The containers 101, 101' each comprise a reservoir 102, 102' and a pump 103, 103'. Each of the pumps 103, 103' can be actuated by means of an associated pump-actuating button 104 and 104', respectively, and each pump 103, 103' is secured to the respective reservoir 102, 102' by means of a securing collar 106 and 106', respectively.

The reservoirs 102, 102' of the combination of the first container 101 and second container 101' can be placed in a reservoir holder 121 which is designed to receive and hold in place virtually the whole of the two reservoirs. If appropriate, it is possible for the reservoir holder 121 to be designed in such a manner that the reservoirs are only partially accommodated in the reservoir holder.

Figure 6:
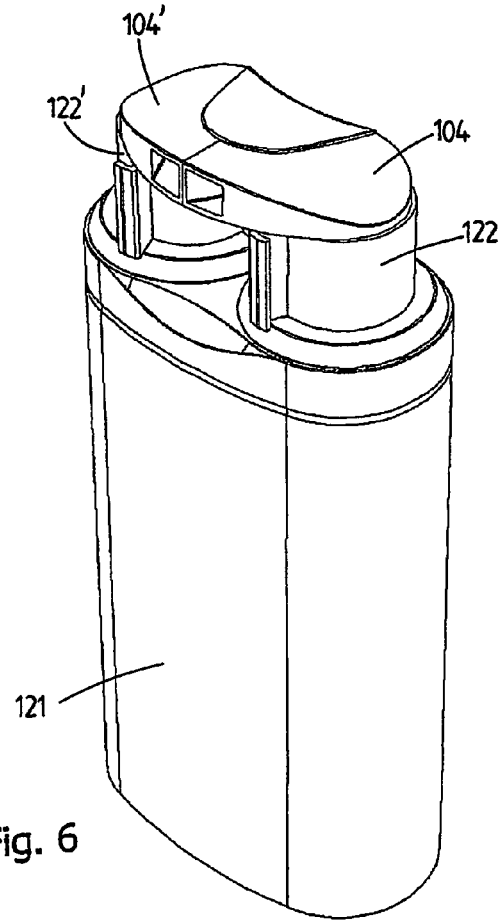
FIG. 6 shows the combination shown in FIG. 5 positioned in a reservoir holder.

The reservoir holder 121 with a combination of a first container 101 and a second container 101' positioned in it is shown in FIG. 6. The securing collars 106, 106' preferably comprise an edge or the like which forms a click-fit connection with a complementary edge in the reservoir holder. The two containers remain seated securely in the reservoir holder as a result of a click-fit connection of this type or some other suitable connection.

If appropriate, it is possible to produce the reservoir holder 121 from two parts, in such a manner that each reservoir 102, 102' can be placed in one of the parts, in which case the parts can then be coupled to one another, optionally releasably, preferably by means of coupling members or the like. These coupling members can be designed in a corresponding way to the coupling members according to the invention for coupling the containers to one another.

Figure 7:
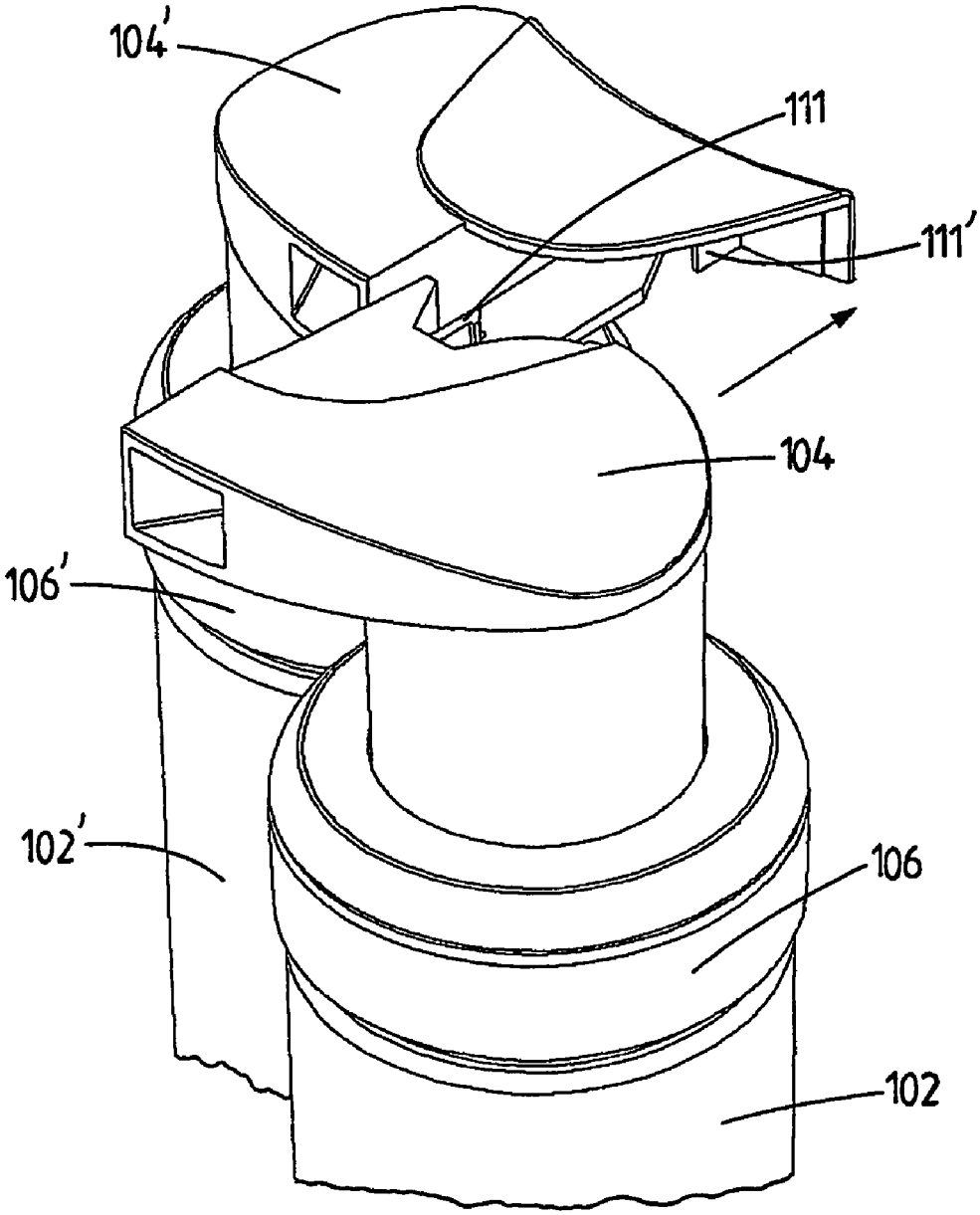
FIG. 7 shows the coupling of the combination of a first container and a second container which is shown in FIG. 5.

The coupling of the pump-actuating buttons 104, 104' of the first container 101 and the second container 101' is shown, at least in part, in FIG. 7. This coupling is what is known as a sliding click-fit connection, in which the two pump-actuating buttons 104, 104' have coupling means which are complementary to one another, in such a manner that the pump-actuating buttons 104, 104' can be pushed together and coupled by means of a movement in the direction of the arrow shown in FIG. 7. The pump-actuating button 104 comprises a coupling member 111 which, functioning as a click-fit connection, can be coupled to a coupling member 111' of the pump-actuating button 104' of the second container 101'. Furthermore, in this case the pump-actuating button 104 comprises a projecting section which fits into a complementary recess in the second pump-actuating button 104'. The projecting section is fixed in the recess by means of the click-fit connection between the first and second coupling members 111, 111'

In the embodiment shown, this projecting section and the complementary recess are located in the vicinity of the dispensing opening of the respective pump-actuating button 104, 104' and cannot be seen in the figures.

As a result of the coupling described here, the two pump-actuating buttons 104, 104' which have been coupled to one another function as a common pump-actuating button for operating both pumps 103, 103' simultaneously.

The containers 101, 101' shown in FIGS. 5 and 6 are each also provided with a cylindrical clamping element 122, 122' which is substantially U-shaped in cross section and comprises two limbs, which are positioned around a relatively narrow section of the pump-actuating button 104 and 104', respectively, and thereby prevent any possibility of the pump-actuating buttons 104, 104' being depressed. These clamping elements 101, 101' therefore function as blocking elements. If appropriate, during production of the container it is possible to produce a (plastic) connection between the clamping element 122, 122' and the respective container 101', 102'. A connection of this type can then be used as a tamper-evident component.

The coupling between the two containers of the embodiments of the dispensing unit according to the invention which have been described and shown may be designed to be releasable. This is advantageous if, for example, it is necessary for it to be possible to mix a base material with various concentrates, for example for different colours or the like. The container with a reservoir containing base material, which is then preferably larger, can then be combined as required with the different containers holding concentrates.

It is also possible to make it difficult to uncouple the two containers from one another. It may even be the case that this uncoupling can only be achieved by using special tools.

Furthermore, it is possible for the containers to be coupled to one another in other ways rather than the method described above, but the method shown here is the simplest method for the embodiment illustrated of the assembly of the two containers.

It should be clear that the various containers can be coupled to one another in various ways to form an assembly according to the invention by means of coupling members which are preferably formed integrally on the containers.

What is claimed is:

1. A dispensing unit formed or to be formed from a combination of a first container and a second container, which first and second containers each have a reservoir for a liquid substance and a pump, which is secured to the reservoir, can be actuated by hand and has a dispensing opening and a pump-actuating button, for dispensing substance from the reservoir, which combination also comprises coupling members for coupling together the first and second containers in a position next to one another, the coupling members comprising one or more first coupling members which are each arranged on the first container, and one or more second coupling members, which are each arranged on the second container and which can each be directly coupled to an associated first coupling member on the first container, whereby each reservoir has an opening at the top side, in which the pump is secured to the reservoir by means of a securing collar, and in that a first coupling member and associated second coupling member are arranged on the securing collar of the first container and the second container, respectively.

2. A dispensing unit as claimed in claim 1, in which a further first coupling member and an associated further second coupling member are each arranged fixedly on the pump-actuating button of the associated container in order to create a stable coupling between the pump-actuating buttons of the two containers.

3. A dispensing unit as claimed in claim 1, in which associated first and second coupling members are designed to form an optionally releasable click-fit connection to one another.

4. A dispensing unit as claimed in claim 3, in which the click-fit connection is an optionally releasable sliding click-fit connection.

5. A dispensing unit as claimed in claim 1, in which a pair of first and second coupling members is respectively arranged on the assembly of reservoir and pump of the first and second containers, respectively, in which the coupling members of each pair are complementary with respect to one another and in which the pairs of coupling members are identical to one another.

6. A dispensing unit as claimed in claim 1, in which the securing collars of the first and second containers are identical.

7. A dispensing unit as claimed in claim 1, in which the pump of each container has a dispensing passage which extends through the pump-actuating button.

8. A dispensing unit as claimed in claim 7, in which the pump-actuating buttons of the first and second containers each have a bearing surface for the other pump-actuating button, and in which the dispensing passage of each pump-actuating button has a dispensing mouth in the vicinity of the bearing surface, so that in the coupled position the dispensing mouths lie adjacent to one another.

9. A dispensing unit as claimed in claim 1, in which the first and second coupling members are designed to form a coupling which can no longer be released by a user.

10. A dispensing unit as claimed in claim 2, in which the further first and second coupling members are designed to hold the first and second containers at an oblique angle with respect to one another, with the pump-actuating buttons together, and then to couple the containers first of all by means of the further coupling members associated with their pump-actuating buttons, and then to pivot the first and second containers towards one another about a hinge which is produced by the further coupling members of the pump-actuating buttons, in such a manner that the coupling members associated with the assembly of reservoir and pump of each of the containers are coupled to one another.

11. A dispensing unit as claimed in claim 1, which also comprises reservoir holder which is designed to at least partially hold the reservoir of the first container and the reservoir of the second container.

12. A dispensing unit as claimed in claim 11, in which the separate reservoirs can be fixed in the reservoir holder by means of a click-fit connection between the reservoir holder and the respective containers.

13. A dispensing unit as claimed in claim 1, in which the dispensing passage in the first container at least partially merges with the dispensing passage in the second container, and in which the dispensing passages have a common dispensing mouth.

14. A dispensing unit as claimed in claim 1, in which there is a removable blocking element for blocking at least one of the pump-actuating buttons of the first or second container.

15. A dispensing unit as claimed in claim 14, in which a blocking element which can be removed is formed integrally on each securing collar.

16. A dispensing unit as claimed in claim 14, in which the blocking element is a cylindrical clamping element which is substantially U-shaped in cross section and which, when the actuating button is in its highest position, can be clamped around a narrower section of the actuating button.

17. A dispensing unit formed or to be formed from a combination of a first container and a second container, which first and second containers each have a cylindrical reservoir for a liquid substance and a pump, which is secured to the reservoir, can be actuated by hand and has a dispensing opening and a pump-actuating button for dispensing substance from the reservoir, which combination also comprises coupling members for coupling together the first and second containers in a position next to one another, the coupling members comprising one or more first coupling members, which are each arranged on the first container, and one or more second coupling members, which are each arranged on the second container and which can each be directly coupled to an associated first coupling member on the first container, characterised in that a first coupling member and an associated second coupling member are each arranged fixedly on the pump-actuating button of the associated container in order to create a stable coupling between the pump-actuating buttons of the two containers and that the dispensing unit further comprises a separate reservoir holder which is designed to at least partially enclose the reservoir of the first container and the reservoir of the second container.

18. A dispensing unit as claimed in claim 17, in which associated first and second coupling members are designed to form an optionally releasable click-fit connection to one another.

19. A dispensing unit as claimed in claim 18, in which the click-fit connection is an optionally releasable sliding click-fit connection.

20. A dispensing unit as claimed in claim 17, in which each reservoir has an opening at the top side, in which the pump is secured by means of a securing collar, and in which a further first coupling member and associated further second coupling member are arranged on the securing collar of the first container and the second container, respectively.

21. A dispensing unit as claimed in claim 17, in which a pair of first and second coupling members is respectively arranged on the assembly of reservoir and pump of the first and second containers, respectively, in which the coupling members of each pair are complementary with respect to one another and in which the pairs of coupling members are identical to one another.

22. A dispensing unit as claimed in claim 17, in which each reservoir has an opening at the top side, in which the pump is secured by means of a securing collar; and in which the securing collars of the first and second containers are identical.

23. A dispensing unit as claimed in claim 17, in which the pump of each container has a dispensing passage which extends through the pump-actuating button.

24. A dispensing unit as claimed in claim 17, in which the pump-actuating buttons of the first and second containers each have a bearing surface for the other pump-actuating button, and in which the dispensing passage of each pump-actuating button has a dispensing mouth in the vicinity of the bearing surface, so that in the coupled position the dispensing mouths lie adjacent to one another.

25. A dispensing unit as claimed in claim 17, in which the first and second coupling members are designed to form a coupling which can no longer be released by a user.

26. A dispensing unit as claimed in claim 17, in which the first and second coupling members are designed to hold the first and second containers at an oblique angle with respect to one another, with the pump-actuating buttons together, and then to couple the containers first of all by means of the coupling members associated with their pump-actuating buttons, and then to pivot the first and second containers towards one another about a hinge which is produced by the coupling members of the pump-actuating buttons, in such a manner that the coupling members associated with the assembly of reservoir and pump of each of the containers are coupled to one another.

27. A dispensing unit as claimed in claim 17, in which the separate reservoirs can be fixed in the reservoir holder by means of a click-fit connection between the reservoir holder and the respective containers.

28. A dispensing unit as claimed in claim 17, in which the dispensing passage in the first container at least partially merges with the dispensing passage in the second container, and in which the dispensing passages have a common dispensing mouth.

29. A dispensing unit as claimed in claim 17, in which there is a removable blocking element for blocking at least one of the pump-actuating buttons of the first or second container.

30. A dispensing unit as claimed in claim 29, in which a blocking element which can be removed is formed integrally on each securing collar.

31. A dispensing unit as claimed in claim 29, in which the blocking element is a cylindrical clamping element which is substantially U-shaped in cross section and which, when the actuating button is in its highest position, can be clamped around a narrower section of the actuating button.

* * * * *

UNITED STATES PATENT AND TRADEMARK OFFICE

CERTIFICATE OF CORRECTION

PATENT NO. : 7,654,415 B2
APPLICATION NO. : 10/507023
DATED : February 2, 2010
INVENTOR(S) : Edgar Ivo Maria van der Heijden It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 437 days.

Signed and Sealed this

Twenty-third Day of November, 2010

David J. Kappos

David J. Kappos
*Director of the United States Patent and Trademark Office*